US008632934B2

(12) United States Patent
Shirai et al.

(10) Patent No.: US 8,632,934 B2
(45) **Date of Patent: *Jan. 21, 2014**

(54) IMAGE FORMING METHOD

(75) Inventors: Aya Shirai, Tokyo (JP); Tatsuya Nagase, Tokyo (JP); Asao Matsushima, Tokyo (JP); Yasuko Uchino, Tokyo (JP); Ryuichi Hiramoto, Tokyo (JP); Michiyo Fujita, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/427,286

(22) Filed: Mar. 22, 2012

(65) Prior Publication Data

US 2012/0251174 A1 Oct. 4, 2012

(30) Foreign Application Priority Data

Mar. 31, 2011 (JP) ..... 2011-078775

(51) Int. Cl.
*G03G 5/00* (2006.01)

(52) U.S. Cl.
USPC ..... 430/126.1

(58) Field of Classification Search
USPC ..... 430/126.1
See application file for complete search history.

(56) References Cited

U.S. PATENT DOCUMENTS 5,520,763 A * 5/1996 Johnstone ..... 156/233

FOREIGN PATENT DOCUMENTS

| | | |
|---|---|---|
| JP | 01-200985 | 8/1989 |
| JP | 2000-127691 | 5/2000 |
| JP | 2007-015159 | 1/2007 |
| JP | 2009-090464 | 4/2009 |

* cited by examiner

*Primary Examiner* — Mark A Chapman
(74) *Attorney, Agent, or Firm* — Lucas & Mercanti, LLP

(57) ABSTRACT

Provided is a method for forming an image containing the sequential steps of: forming a foil adhesion toner image on an image supporting substrate with a foil adhesion toner (α) which comprises at least a binder resin containing a thermoplastic resin using an electrophotographic method; forming a foil image on the foil adhesion toner image by contacting a transfer foil on the foil adhesion toner image with applying heat; and forming a visible toner image on the image supporting substrate which has been formed with the foil image with at least one image forming toner (β) using an electrophotographic method, followed by fixing the visible toner image by applying heat and pressure thereto, wherein Δ(Tsp(α)−Tsp(β)) is 5 to 50° C., provided that Tsp (α) is a softening point of the foil adhesion toner (α) and Tsp (β) is a softening point of the image forming toner (β).

9 Claims, 4 Drawing Sheets

IMAGE FORMING METHOD

This application is based on Japanese Patent Application No. 2011-078775 filed on Mar. 31, 2011 with Japan Patent Office, the entire content of which is hereby incorporated by reference.

TECHNICAL FIELD

The present invention relates to a method for forming an image on an image supporting substrate comprising the steps of forming a foil image by adhering a transfer foil on a foil adhesion toner image produced with a foil adhesion toner using an electrophotographic method, subsequently, a visible image is formed with a visible image forming toner (hereafter it is also called as an "image forming tone") using an electrophotographic method.

BACKGROUND

In a field of bookbinding, a commercial printing, a card business or a plastic molding such as a cosmetic container, a printing processing treatment called a "foil stamping" is conducted. This treatment is also called a "hot stamp method", and by using a pressure bonding member called a metal stamper, a text or a picture made of a metallic foil is transferred to a base substance surface by heat and pressure, a metallic appearance or an expensive look can be achieved which cannot be expressed merely by common printing. Further, in recent years, a foil transferring technology has been developed to make a hologram on a cash card or a credit card in order to prevent falsification or alteration, or for the security of these cards.

A foil used for the foil stamping is supplied as a transfer foil. An example of a transfer foil has a structure which contains a resin film substrate and a wax layer on the resin film substrate, and on the wax layer, there is provided a foil composed of a protective layer, a transfer material layer and an adhesive layer. A generally used transfer material layer is formed by vacuum deposition of metal or using an ink. The technique to produce a transfer foil has been improved in accordance with the enlargement of the market of the transfer foil. For example, there have been advanced researches on a transfer foil having a protective layer containing an organic silicon compound and a reactive organic compound in view of improving the durability of a foil image, and on a transfer foil having an electron beam curable adhesive layer by which a stronger protective layer is formed by irradiation with an electron beam after peeled from the support (for example, refer to Patent Documents 1 and 2). Since many of these transfer images used for the prevention of falsification or for security of the cards contain a precise pattern, it is required to accurately transfer the image without causing a problem such as a burr or missing of the foil. In accordance with such a requirement, there has been examined a transfer foil by which, by incorporating a polymer liquid crystal material in a transfer layer, a precise-shaped label is accurately transferred without causing defects such as burrs or missing of the foil (for example, refer to Patent document 3).

On the other hand, it has been examined a process to conduct foil transfer without complicated steps. For example, there was proposed a technique to form a toner image on an image supporting substrate, then a foil is provided thereon by adhesion. Specifically, a predetermined design image is formed on an image supporting substrate by using a toner, followed by heat-pressing a transfer foil onto the formed toner image, resulting in transferring a foil (for example, refer to Patent document 4). In this technique, by synergistic effect produced by an adhesive force formed by softening or melting of a toner and an adhesive force formed by melting of an adhesive layer of a transfer foil via heating, a strong adhesion between an image supporting substrate and a foil can be realized. Further, there was proposed a technique for transferring a metal foil on an image supporting substrate. In this technique, a toner is preliminary adhered on a an image supporting substrate, then a transfer foil is laminated thereon, and it was hot pressed with an iron, followed by peeling the film substrate of the transfer foil from the image supporting substrate (for example, refer to Patent document 5).

In these foil transfer techniques which use a toner, foil transferring can be carried out without using a metal pressing member which is required in the conventional technique, resulting in reducing necessary time for a foil transfer process or simplifying an apparatus of a foil transfer.

[Patent document 1] Unexamined Japanese Patent Application Publication (hereinafter referred to as JP-A) No. 9-1995

[Patent Document 2] JP-A No. 2007-15159

[Patent Document 3] JP-A No. 2009-90464

[Patent Document 4] JP-A No. 1-200985

[Patent Document 5] JP-A No. 2000-127691

SUMMARY

In some cases, a heat treatment is added on a foil image which has been produced by transferring a foil on the image supporting substrate. Specifically, there is a case of so-called "overprinting" in which a conventional visible image is formed with an image forming toner on an image supporting substrate on which a foil image has been already formed, then the visible toner image is formed by fixing with applying heat and pressure.

Thus, when the heat and pressure treatment is carried out onto the image supporting substrate on which a foil image has been formed by adhering with a toner, the toner participating in adhesion of the foil may be melted again or may be softened with heat, and there may cause a deteriorated finish having micro cracks (hereinafter, referred to as "stripe") on the surface of the foil image. Therefore, in the case of forming further an image onto the image supporting substrate having been provided with a transferring foil image, there have been investigated the image forming methods other than an electrophotographic method such as an ink-jet or an offset printing. However, these are not preferable because the image supporting substrate is limited and overall processes become complex.

In view of the foregoing background, the present invention has been achieved. An object of the present invention is to provide a method for forming an image containing both a foil image and a visible image which are excellent in finish without any finish deformation such as stripes on the foil image even when a heat and pressure treatment is conducted so as to form a visible image on the image supporting substrate which has been provided with a foil image adhered with a toner.

The above object has been attained by any one of the constitutions described below.

A method for forming an image comprising the sequential steps of:

forming a foil adhesion toner image on an image supporting substrate with a foil adhesion toner ($\alpha$) which comprises at least a binder resin containing a thermoplastic resin using an electrophotographic method;

forming a foil image on the foil adhesion toner image by contacting a transfer foil on the foil adhesion toner image with applying heat to the transfer foil; and forming a visible toner image on the image supporting substrate which has been formed with the foil image with at least one image forming toner (β) using an electrophotographic method, followed by fixing the visible toner image by applying heat and pressure thereto, wherein a difference of two softening points expressed as Δ(Tsp(α)−Tsp(β)) is 5 to 50° C., provided that Tsp (α) is a softening point of the foil adhesion toner (α) and Tsp (β) is a softening point of the image forming toner (β).

In the method for forming an image of the present invention, it is preferable that a heating temperature for fixing the visible toner image in the visible toner image forming step is 150 to 230° C., and a nip time for fixing the visible toner image is 10 to 300 msec.

In the method for forming an image of the present invention, it is preferable that the softening point of the foil adhesion toner (α) is 105 to 140° C., and the foil adhesion toner (α) is 105 to 140° C. contains a binder resin which has a resin component having a weight average molecular weight (Mw) of 60,000 or more in an amount of 10 to 30 mass % based on the total amount of the binder resin.

Moreover, in the method for forming an image of the present invention, it is preferable that the binder resin contained in the foil adhesion toner (α) is a styrene-acrylic resin.

According to the method for forming an image of the present invention, since a difference of softening points expressed as Δ(Tsp(α)−Tsp(β)) is controlled to be in the specific range, here, Tsp(α) being a softening point of the foil adhesion toner (α) and Tsp(β) being a softening point of the image forming toner (β), it is almost completely prevented a foil adhesion toner image produced with a foil adhesion toner (α) from melting or softening by heat to result in causing flow when the foil adhesion toner image is subjected to a heat-pressure treatment in order to fix the visible toner image. As a result, it will not be produced stripes caused by strain on the foil adhered to the image supporting substrate. Therefore, it can form a visible image under the condition that the expected finish state in the foil image forming process is maintained. Consequently, it can be easily obtained an image having both a visible image in an expected excellent finish state and an expected visible image.

DESCRIPTION OF THE PREFERRED EMBODIMENT

Figure 1:
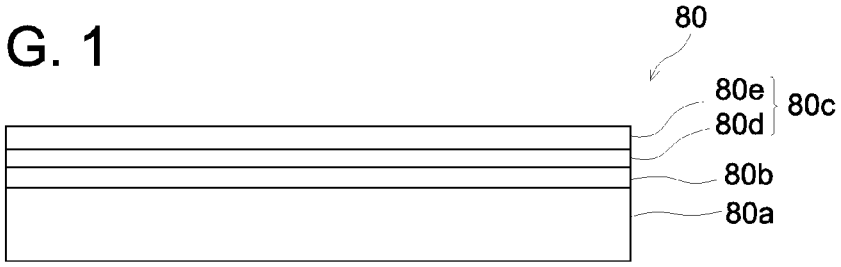
FIG. 1 is a cross-sectional view for explanation showing the cross-section structure of the foil used for the image forming method of the present invention.

Hereafter, the present invention will be described specifically.

The image forming method of the present invention is performed as a combination of the following process: (i) a foil image forming process in which a foil adhesion toner image is formed on an image supporting substrate with a foil adhesion toner (α) which comprises at least a binder resin containing a thermoplastic resin using an electrophotographic method, followed by contacting a transfer foil on the foil adhesion toner image with applying heat to the transfer foil so as to form a foil image; and (ii) a visible image forming process (or called as an overprinting process) in which a visible toner image is formed on the image supporting substrate which has been formed with the foil image with at least one image forming toner (β) using an electrophotographic method, followed by fixing the visible image by applying pressure with heating thereto. In addition, if the foil image forming process is carried out after forming a visible toner image, a foil may be adhered on the visible image. Therefore, it is preferable that the overprinting process is performed after performing the foil image forming process.

[Relationship Between Softening Point of Foil Adhesion Toner (α) and Softening Point of Image Forming Toner (β)]

In the method for forming an image of the present invention, a difference of softening points expressed as Δ(Tsp(α)−Tsp(β)) is controlled to be in the range of 5 to 50° C., here Tsp(α) is a softening point of the foil adhesion toner (α) and Tsp(β) is a softening point of the image forming toner (β). It is more preferably controlled to be in the range of 6 to 28° C. (hereafter, Δ(Tsp(α)−Tsp(β)) is also called simply "a difference of softening points").

By controlling the difference of softening points of the foil adhesion toner (α) and the image forming toner (β) in the above-described range, it is extremely prevented a foil adhesion toner image produced with a foil adhesion toner (α) from melting or softening by heat to result in causing flow when the foil adhesion toner image is subjected to a heat-pressure treatment in order to fix the visible toner image. As a result, it will not be produced stripes caused by strain on the foil adhered to the image supporting substrate when it is applied pressure. Therefore, it can form a visible image under the condition that the expected finish state in the foil image forming process is maintained. Consequently, an image having both a foil image of an excellent finish state and an expected visible image can be easily produced. On the other hand, when the difference of softening points of the foil adhesion toner (α) and the image forming toner (β) is too small, a foil adhesion toner image produced with a foil adhesion toner (α) will be melted or softened by heat to result in causing flow when the foil adhesion toner image is subjected to a heat-pressure treatment in order to fix the visible toner image. Moreover, when the difference of softening points of the foil adhesion toner (α) and the image forming toner (β) is too large, it is required to set the heating temperature at high temperature for forming the foil image. Thereby, an environmental impact becomes large.

The softening point related to the present invention can be determined and calculated by a conventional measuring method such as Flow tester method. The specific measurement of the softening point by Flow tester method is done as follows.

(1) Preparation of Sample

Under an environment of 20±1° C. and 50±5% RH, 1.1 g of measuring sample (the foil adhesion toner (α) or the image forming toner (β)) is placed into a Petri dish and leveled off. After being allowed to stand for at least 12 hours, the sample is compressed for 30 seconds under a force of 3,820 kg/cm$^2$ using a molding device "SSP-A" (produced by Shimazu Seisakusho, Ltd.) to prepare a cylindrical molded sample of a 1 cm diameter.

(2) Measurement of Softening Temperature

Under an environment of 24±5° C. and 50±20% RH, the above molded sample is set in a flow tester "CFT-500D" (produced by Shimazu Seisakusho, Ltd). Then, the prepared sample is extruded through a hole of a cylindrical die (1 mm diameter×1 mm) using a piston of 1 cm diameter after completion of pre-heating under conditions of a load weight of 196 N (20 kgf), at an initial temperature of 60° C., a pre-heating time of 300 seconds and temperature-raising rate of 6° C./minute. Herein, extrusion began after finishing pre-heating. An offset method temperature ($T_{offset}$), which is determined by a melting temperature measurement method (temperature-raising method) at an offset value of 5 mm, is defined as the softening point of the measuring sample.

[Foil Adhesion Toner (α)]

The foil adhesion toner (α) used for the image forming method of the present invention is a toner which exhibits an effect as an adhesive agent for pasting up a foil on an image supporting substrate. This toner comprises at least a binder resin containing a thermoplastic resin. Although this toner my be a color toner containing a colorant, or it may be a transparent clear toner, since the effect on the foil image or on the visibility of the visible image formed afterward is small, it is desirable that the foil adhesion toner (α) is a clear toner.

In the present invention, a clear toner designates a toner which does not contain a colorant such as a pigment or a dye. Provided that, unless the color of the toner is not recognized by the effects of light absorption or light scattering when the toner is subjected to heat-pressing to form a fixed layer, it is also called a clear toner even when the toner contains a very small amount of colorant such as pigment or dye, or when the toner contains a colored material of a binder resin, a wax or an external additive, for example. The softening point of the foil adhesion toner (α) can be suitably determined to a desired softening point by tuning of the type of the binder resin, the type of raw materials and their content ratio and molecular weight.

[Thermoplastic Resin]

The followings are cited as thermoplastic resins contained in the binder resin constituting the foil adhesion toner (α) relating to the present invention. Examples of the thermoplastic resin are conventionally known resins including: vinyl system resins such as a styrene resin, a (meth)acrylic resin, a styrene-(meth)acrylic copolymer resin, and an olefin resin; a polyester resin, a polyamide resin, a polycarbonate resin, a polyether resin, a polyvinyl acetate resin, a polysulfone resin, and a polyurethane resin. These can be used singly or by combining two or more sorts. Among them, a styrene-acrylic resin is preferable from the viewpoint of controlling the molecular weight for adjusting the softening point of the binder resin.

It is preferable that the foil adhesion toner (α) particles constituting the foil adhesion toner (α) relating to the present invention have a softening point of 105 to 140° C., and more preferably, have a softening point of 112 to 137° C. Further, it is preferable that the binder resin contained in the foil adhesion toner (α) has a resin component having a molecular weight (Mw) of 60,000 or more in a molecular weight distribution measured with GPC in a ratio of 10 to 30 mass % based on the total amount of the binder resin (hereafter, this ratio is called as "high molecular polymer component ratio"). It is preferable that the aforesaid binder resin has a weight average molecular weight of about 10,000 to 30,000 of the weight average molecular weight (Mw).

By having the above-described softening point and high molecular polymer component ratio, the foil adhesion toner (α) will have the following properties. It can exhibits an appropriate adhesiveness when heat is applied in the foil image forming process, and at the same time, it will not produce fluidity that will deform the foil adhesion toner image portion made of the foil adhesion toner (α) by the heat given in the overprinting process. As a result, it will not be produced stripes caused by strain on the foil adhered to the image supporting substrate when it is applied pressure. Therefore, it can form a visible image under the condition that the expected finish state in the foil image forming process is maintained. On the other hand, when the softening point is too small, although it can obtain a softening property which enables the foil adhesion toner (α) to adhere the foil closely, it will easily produce deformation of the foil adhesion toner image portion by heat. As a result, it may be produced stripes caused by strain on the foil when it is applied pressure with heat to the image supporting substrate having been formed with a foil image in the overprinting process. Moreover, when the softening point is too large, since it is required a high amount of energy in order to paste up a foil, there is a possibility that the adhesive strength of a foil may be insufficient, or an environmental impact may become large. Moreover, when the high molecular polymer component ratio is too small, there is a possibility that the aggregation force between the resin molecules becomes insufficient due to the fact that the intertwinement of the resin molecular chains which constitute the binder resin of the foil adhesion toner (α) is insufficient. Consequently, it will be easily produced deformation of the foil adhesion toner image portion by heat, as a result, it may be produced stripes caused by strain on the foil when it is applied pressure with heat to the image supporting substrate having been formed with a foil image in the overprinting process. Further, when the high molecular polymer component ratio is too large, since the molecular aggregation force between the resin molecules constituting the binder resin of the foil adhesion toner (α) becomes too strong, it is needed to set the heating temperature at high temperature in the formation of a foil image, and an environmental impact may become large.

The molecular weight distribution of the binder resin and the high molecular polymer component ratio of the binder resin contained in the foil adhesion toner (α) concerning the present invention are calculated based on the weight average molecular weight (Mw) measured as follows.

The molecular weight distribution can be measured using a gel permeation chromatography (GPC) for the ingredient which is soluble in tetrahydrofuran (THF). Namely, an apparatus "HLC-8020" (produced by TOSO Co., Ltd.) and columns of "TSK guard column+TSK gel Super HZM-M, three-stranded" (produced by TOSO Co., Ltd.) are employed. While keeping the column temperature at 40° C., tetrahydrofuran (THF) is drained at an effluent rate of 0.2 ml/min as a carrier solvent. The measuring sample (foil adhesion toner (α)) is dissolved in tetrahydrofuran (THF) at room temperature, while being stirred for 5 min. by an ultrasonic homogenizer to obtain a solution at a concentration of 1 mg/ml. Subsequently, the solution is filtered with a membrane filter having a pore size of 0.2 μm to obtain a sample solution. Into the apparatus was injected 10 μl of the obtained sample solution. The measurement is done using a refractive index detector (RI detector). The molecular weight distribution of the measuring sample is determined by a calibration curve prepared by using monodisperse polystyrene standard polystyrene. The monodisperse polystyrene standard polystyrene samples used for preparing the calibration curve are samples made of Pressure Chemical, Co. Ltd. and having a molecular weight of: $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. At least 10 points of monodisperse polystyrene standard polystyrene samples are measured to prepare a styrene calibration curve. A refractive index detector is used as a detector.

[Preparation of Foil Adhesion Toner (α)]

A method for preparing a foil adhesion toner (α) relating to the present invention is not specifically limited. Any know methods can be used such as: a kneading-grinding method, a suspension polymerization method, an emulsion polymerization aggregation method, an emulsion polymerization association method, and a mini-emulsion polymerization aggregation method.

When a binder resin containing a styrene-acrylic resin is used to prepare a foil adhesion toner (α), an emulsification aggregation method is preferable, since it is easy to control the high molecular polymer component ratio in the binder resin. An example of preparation with an emulsion polymerization association method is described below.

An emulsion polymerization association method is a method for preparing foil adhesion toner (α) particles and it contains the following steps. A dispersion of particles made of a binder resin which is prepared with an emulsion polymerization method (these particles are also called as "binder resin particles") is mixed with a dispersion containing other constituting components of foil adhesion toner (α) particles such as colorant particles and wax particles. The mixture of the dispersions is allowed to be aggregated slowly while controlling a balance between a repulsion force of particle surface by pH adjustment and an aggregation force by addition of an aggregation agent made of an electrolyte. The aggregation of particles is performed with controlling an average particle size and a particle size distribution, and at the same time, the mixture is stirred with heating, whereby fusion of particles is performed to control the shape of the associated particles to result in forming the foil adhesion toner (α) particles.

The above-described binder resin particles may have a composition of two or more layers each having a binder resin of a different constitution. In this case, it can be adopted a multi-step polymerization method in which a dispersion of a first resin particles prepared with a conventional emulsion polymerization method (a first-step polymerization) is prepared; then to this dispersion are added a polymerization initiator and a polymerizable monomer and the mixture is subjected to polymerization treatment (a second-step polymerization).

When an emulsion polymerization association method is used for preparing a foil adhesion toner (α), it can be prepared toner particles having an expected softening point and high molecular polymer component ratio by adjusting an amount of an aggregation agent which is added to aggregate the bonder resin particles, and by adjusting the temperature and the time for a radical polymerization reaction.

Moreover, when the binder resin particles are prepared with a multi-step polymerization method, it can be prepared toner particles having an expected softening point and high molecular polymer component ratio by further controlling: a content ratio of the used monomers; and a kind and/or an amount of a radical polymerization initiator and a chain transfer agent.

One of the examples of the preparation steps for obtaining a foil adhesion toner (α) of the present invention with an emulsion polymerization association method is specifically described.

(1) Binder resin particle polymerization step: a radical polymerization initiator is allowed to react with a polymerizable monomer which forms a binder resin in an aqueous medium to obtain binder resin particles.

(2) Association step: an aggregation agent is added in the aqueous medium containing the binder resin particles, by controlling the temperature, salting-out is progressed and at the same time, aggregation and fusing of the binder resin particles is done to form associated particles.

(3) Ripening step: a foil adhesion toner (α) is prepared by controlling the shape of the associated particles.

(4) Filtering and washing step: the foil adhesion toner (α) is filtered to remove a surfactant an others from the foil adhesion toner (α) particles.

(5) Drying step: the washed foil adhesion toner (α) is dried.

(6) External additive adding step: an external additive is added to the dried foil adhesion toner (α) particles.

Here, "an aqueous medium" indicates a solvent composed of 50 to 100 mass % of water and 0 to 50 mass % of water-soluble organic solvent. Examples of a water-soluble organic solvent include: methanol, ethanol, isopropanol, butanol, acetone, methyl ethyl ketone, and tetrahydrofuran. Among these, alcoholic solvents such as methanol, ethanol, isopropanol, and butanol are preferable since they will not dissolve the obtained resin.

(1) Binder Resin Particle Polymerization Step

This binder resin particle polymerization step specifically is performed as follows. A polymerizable monomer described later is added in an aqueous medium and the mixture is dispersed by applying a mechanical energy to form oil droplets of the polymerizable monomer. In this state, the polymerizable monomer is allowed to radical polymerize with an emulsion polymerization method, whereby binder resin particles having a volume-based median diameter of about 50 to 300 nm are formed.

A dispersion apparatus with which oil droplets are formed by applying a mechanical energy is not specifically limited. A representative example thereof is "CLEARMIX" (produced by M Technique Co., Ltd) provided with high speed rotating rotors. It can be used other agitating apparatuses than the apparatus provided with high speed rotating rotors as described above. Such dispersion apparatus includes ultrasonic homogenizers, mechanical homogenizers, Manton-Gaulin, and pressure system homogenizers.

The temperature relating to the radical polymerization, which varies depending on the kinds of used polymerizable monomer or radical polymerization initiator, is preferably 50 to 100° C., and more preferably 55 to 90° C. The time required for polymerization, which varies depending on the kinds of polymerizable monomer or reaction rate of radicals generated from the radical polymerization initiator, is preferably 2 to 12 hours, for example.

Specific examples of the polymerizable monomer used for obtaining a thermoplastic resin contained in the foil adhesion toner (α) of the present invention are listed below. (1) Styrene based monomer (Styrene or Styrene derivatives): styrene, o-methylstyrene, m-methylstyrene, p-methylstyrene, α-methylstyrene, p-phenylstyrene, p-ethylstyrene, 2,4-dimethylstyrene, p-tert-butylstyrene, p-n-hexylstyrene, p-n-octylstyrene, p-n-nonylstyrene, p-n-decylstyrene and p-n-dodecylstyrene;

(2) Methacrylate based monomer (Methacrylic acid or Methacrylate Derivatives): methacrylic acid, methyl methacrylate, ethyl methacrylate, n-butyl methacrylate, isopropyl methacrylate, isobutyl methacrylate, t-butyl methacrylate, n-octyl methacrylate, 2-ethylhexyl methacrylate, stearyl methacrylate, lauryl methacrylate, phenyl methacrylate, diethylaminoethyl methacrylate and dimethylaminoethyl methacrylate;

(3) Acrylic acid based monomer (Acrylic acid or Acrylic acid ester derivatives): acrylic acid, methyl acrylate, ethyl acrylate, isopropyl acrylate, n-butyl acrylate, t-butyl acrylate, isobutyl acrylate, n-octyl acrylate, 2-ethylhexyl acrylate, stearyl acrylate, lauryl acrylate and phenyl acrylate.

The above-described polymerizable monomers can be used singly or by combining two or more kinds.

Further, the following vinyl polymerizable monomer may be used in combination with the above styrene based monomer and (meth)acrylic acid based monomer.

(4) Olefins: ethylene, propylene and isobutylene;

(5) Vinyl Esters: vinyl propionate, vinyl acetate and vinyl benzoate;

(6) Vinyl Ethers: vinyl methyl ether and vinyl ethyl ether;

(7) Vinyl Ketones: vinyl methyl ketone, vinyl ethyl ketone and vinyl hexyl ketone;

(8) N-Vinyl Compounds: N-vinylcarbazole, N-vinylindole and N-vinylpyrrolidone; and (9) Others: vinyl compounds such as vinylnaphthalene and vinylpyridine, acrylic or methacrylic derivatives such as acrylonitrile, methacrylonitrile, and acrylamide.

Further, it is possible to prepare resins having a cross-linking structure by employing polyfunctional vinyl compounds.

(10) Polyfunctional vinyl compounds: ethylene glycol dimethacrylate, ethylene glycol diacrylate, diethylene glycol dimethacrylate, diethylene glycol diacrylate, triethylene glycol dimethacrylate, triethylene glycol diacrylate, neopentyl glycol methacrylate, and neopentyl glycol diacrylate.

[Surfactants]

In the binder resin particle polymerization step, it can be added a suitable amount of dispersion stabilizing agent in order to stably disperse particles in an aqueous medium.

Examples of the dispersion stabilizing agent include: tricalcium phosphate, magnesium phosphate, zinc phosphate, aluminium phosphate, calcium carbonate, magnesium carbonate, calcium hydroxide, magnesium hydroxide, aluminium hydroxide, calcium meta-silicate, calcium sulfate, barium sulfate, bentonite, silica, and alumina.

In addition, conventionally used surfactant can be added. Examples thereof include: polyvinyl alcohol, gelatin, methyl cellulose, sodium dodecylbenzene sulfonate, an ethyleneoxide adduct, and sodium sulfate of higher alcohol. As usable surfactants, there can be used conventionally known ionic surfactants and non-ionic surfactants.

Ionic surfactant includes sulfonates, sulfate esters and fatty acid salts. Specific examples of sulfonate include sodium dodecylbenzenesulfonate, sodium arylalkyl polyether sulfonate, sodium 3,3-disulfondisphenylurea-4,4-diazo-bis-amino-8-naphthol-6-sulfonate, ortho-carboxybenzene-azo-dimethylaniline, 2,2,5,5-tetramethyl-triphenylmethane-4,4-diazo-bis-β-naphthol-6-sulfonate.

Specific examples of sulfate esters include: sodium dodecylsulfate, sodium tetradecylsulfate, sodium pentadecylsulfate, and sodium octylsulfate; fatty acid salts include sodium oleate, sodium laurate, sodium caprate, sodium caprylate, sodium caproate, potassium stearate, and calcium oleate.

Nonionic surfactants are also usable. Examples thereof include polyethylene oxide, polypropylene oxide, a combination of polypropylene oxide and polyethylene oxide, an ester of polyethylene glycol and a higher fatty acid, alkylphenol polyethylene oxide, an ester of polypropylene oxide and a higher fatty acid, and sorbitan ester.

[Waxes: Releasing Agents]

The foil adhesion toner (α) of the present invention according to the present invention may contain a wax as a releasing agent, and known releasing agents may be used. Specifically used waxes are, for example: polyethylene wax, oxidized polyethylene wax, polypropylene wax, oxidized polypropylene wax, carnauba wax, Sasol wax, rice wax, candelilla wax, jojoba wax, and bees wax.

The methods to incorporate a wax in the foil adhesion toner (α) are as follows: to include a wax in the binder resin particles as described above; and to added a dispersion containing wax particles in an aqueous medium in the association step of the foil adhesion toner (α) particles, and all of the binder resin particles, colorant particles and wax particles are salted-out, aggregated and fused. These methods can be used together.

The amount of the wax contained in the foil adhesion toner (α) is preferably 0.5 to 5 mass %, and more preferably 1 to 3 mass % based on 100 mass % of the binder resin. When the amount of the contained wax is less than 0.5 mass % based on 100 mass % of binder resin, sufficient offset preventing effect cannot be obtained. On the other hand, when the amount of the contained wax is more than 5 mass % based on 100 mass % of binder resin, the obtained foil adhesion toner (α) may have low light transparency and decreased color reproducing property.

[Charge Controlling Agents]

The charge controlling agent contained in the foil adhesion toner (α) of the present invention is a material which is capable to give positive or negative charge by triboelectric charging. It is not particularly limited as long as it is colorless, and various known charge controlling agents of positive charging and negative charging can be used.

The amount of the charge controlling agent contained in the foil adhesion toner (α) is preferably 0.01 to 30 mass %, and more preferably 0.1 to 10 mass % based on 100 mass % of the binder resin.

The same methods to incorporate a wax can be cited for the methods to incorporate a charge controlling agent in the foil adhesion toner (α).

[Polymerization Initiator]

An appropriate oil-soluble or a water-soluble polymerization initiator can be applied for a polymerization initiator used in the binder resin particle polymerization step.

Specific examples of an oil-soluble polymerization initiator are as follows.

(1) Azo-Type or Diazo-Type Polymerization Initiators: 2,2'-azobis-(2,4-dimethylvaleronitrile), 2,2'-azobisisobutyronitrile, 1,1'-azobiscyclohexanone-1-carbonitrile), 2,2'-azobis-4-methoxy-2,4-dimethylvaleronitrile, and azobisisobutyronitrile.

(2) Peroxide based polymerization initiators: benzoyl peroxide, methyl ethyl ketone peroxide, diisopropyl peroxycarbonate, cumene hydroperoxide, t-butyl hydroperoxide, di-t-butyl peroxide, dicumyl peroxide, 2,4-dichlorobenzoyl peroxide, lauroyl peroxide, 2,2-bis-(4,4-t-butylperoxy-cyclohexane) propane, and tris-(t-butylperoxy)triazine.

Specific examples of a water-soluble polymerization initiator include persulfates such as potassium per sulfate and ammonium persulfate, azobisaminodipropane acetate, azobiscyanovaleric acid and its salts, and hydrogen peroxide.

[Chain Transfer Agents]

Conventional chain transfer agents are usable for the purpose of controlling the molecular weight of resin particles in the binder resin particle polymerization step. The chain transfer agents are not particularly limited. Examples of the chain-transfer agents include: n-octylmercaptan, dodecylmercaptane, tert-dodecylmercaptan, n-octyl-3-mercaptopropionic acid ester, terpinolene, carbon tetrabromide, and α-methylstyrene dimmer.

The steps from (2) Association step to (6) External additive adding step can be done according to the conventionally known various methods.

[Aggregating Agent]

Examples of an aggregating agent used in the association step are alkali metal salts and alkaline earth metal salts. The alkali metals composing the aggregating agent include, for example, lithium, potassium and sodium. The alkaline earth metals composing the aggregating agent include, for example, magnesium, calcium, strontium, and barium. Among them, potassium, sodium, magnesium, calcium, and barium are preferably used. Examples of the counter ions (which form salts) for the alkali metals and alkaline earth metals are: chloride ion, bromide ion, iodide ion, carbonate ion, and sulfate ion.

[External Additives]

The above-mentioned foil adhesion toner (α) particles can constitute the foil adhesion toner (α) concerning the present invention without any modification. However, in order to improve fluidity, a electrostatic charging property, and cleaning property, it may add external additives such as a fluidity improving agent and a cleaning assistant agent as an after treatment agent to constitute the foil adhesion toner (α) of the present invention.

Examples of an external additive are cited as: inorganic oxide particles composed of silica particles, alumina particles, and titanium oxide particles; inorganic stearic acid compound particles such as aluminum stearate particles and zinc stearate particles; and inorganic titanic acid compound particles such as strontium titanate and zinc titanate. These may be used singly or may be used in combination of toe or more kinds.

As for these inorganic matter particles, it is preferable that surface treatment is performed by a silane coupling agent, a titanium coupling agent, a higher fatty acid, a silicone oil, etc. for improvement in heat-resistant keeping nature and improvement in environmental stability.

Moreover, it can be used spherical organic particles whose number average primary particle diameter is about 10 to 2,000 nm as an external additive. Specific examples of such organic particles that can be used are: particles made of homopolymers and these copolymers of styrene and methyl methacrylate.

The added amount of these various external additives is preferably 0.05 to 5 mass %, and more preferably 0.1 to 3 mass % based on 100 mass % of the foil adhesion toner (α). In addition, various types of external additives may be used by combining.

[Visible Image Forming Toner (β)]

The image forming toner (β) used for the image forming method of the present invention is not particularly limited as long as a difference of softening points between the softening point Tsp(β) of the image forming toner (β) and the softening point Tsp(α) of the foil adhesion toner (α) is controlled to be in the range of 5 to 50° C., with keeping the condition of Tsp(α) being larger than Tsp(β). Conventionally known electrophotographic toners can be used for the image forming toner (β).

This image forming toner (β) is not particularly limited if an expected image can be obtained. Although it may be a color toner containing a colorant, or it may be a clear toner, it is preferable to be a color toner containing a colorant. When the toner particles are formulated by containing a colorant, various organic or inorganic pigments as listed below can be used as a colorant.

Namely, as a colorant for a black toner, it can be used: carbon black, magnetic substance, iron-titanium complex oxide black. As usable carbon black, there can be cited: channel black, furnace black, acetylene black, thermal black, and lamp black. It can be cited ferrite and magnetite as a magnetic substance.

As a colorant for a yellow toner, it can be used a dye such as: C. I. Solvent Yellow 19, 44, 77, 79, 81, 82, 93, 98, 103, 104, 112, and 162; and it can be also used a pigment such as: C. I. Pigment Yellow 14, 17, 74, 93, 94, 138, 155, 180, and 185. The mixture of these colorants can be also used.

As a colorant for a magenta toner, it can be used a dye such as: C. I. Solvent Red 1, 49, 52, 58, 63, 111, and 122; and it can be also used a pigment such as: C. I. Pigment Red 5, 48:1, 53:1, 57:1, 122, 139, 144, 149, 166, 177, 178, and 222. The mixture of these colorants can be also used.

As a colorant for a cyan toner, it can be used a dye such as: C. I. Solvent Blue 25, 36, 60, 70, 93, and 95; and it can be also used a pigment such as: C. I. Pigment Blue 1, 7, 15, 60, 62, 66, and 76. The mixture of these colorants can be also used.

The contained amount of these colorants in the toner particles is preferably 0.5 to 20 mass %, and more preferably 2 to 10 mass % based on 100 mass % of the toner particles.

[Preparation Method of Visible Image Forming Toner (β)]

The image forming toner (β) of the present invention can be prepared in the same manner as used for preparation of the foil adhesion toner (α), except that the softening point is adjusted by selecting the kind and the amount of the binder resin, and that the colorant is suitable incorporated if the toner contains a colorant. Specifically, when the image forming toner (β) is prepared with an emulsion polymerization association method, the following steps are performed. In the above-described (2) association step for the preparation method of a foil adhesion toner (α), to a dispersion liquid of the binder resin particles dispersed in an aqueous medium is added another dispersion liquid separately prepared by dispersing colorant particles in an aqueous medium followed by mixing these dispersion liquids. Then, to the aqueous medium containing these binder resin particles and colorant particles is added an aggregation agent. By controlling the temperature, salting-out is progressed, and at the same time, aggregation and fusing are performed resulting to form associated colored particles whereby image forming toner (β) can be prepared.

[Particle Size of Toner Particles]

The particle size of toner particles constituting the above-described foil adhesion toner (α) and image forming toner (β) is preferably a volume-based median diameter of 3 to 10 μm, and more preferably 5 to 8 μm.

The volume-based median diameter of toner particles can be measured and determined using an apparatus composed of "Coulter Counter Multisizer 3" (made by the Beckmann Coulter Company) connected with a computer system (made by the Beckmann Coulter Company) carrying a software for data processing "Software V3.51".

The measurement processes are as follows. 0.02 g of test sample (a foil adhesion toner (α) or an image forming toner (β)) is tamed in 20 mL of surfactant solution (for the purpose of dispersing the test sample, the surfactant solution is prepared by diluting the neutral detergent which contains a surfactant with ten time amount of pure water). Then, ultrasonic homogenization is performed for 1 minute and a toner dispersion liquid is prepared. This toner dispersion liquid is poured into a beaker containing ISOTONI1 (made by the Beckmann Coulter Company) in a sample stand with a pipet until a measuring instrument displaying concentration becomes 5% to 10%. A reproducible measurement value is obtained by using this concentration extent. In the measuring instrument, a measurement particle count number is set to be 25,000 pieces, an aperture diameter is set to be 100 μm, and the frequency values are calculated by dividing the measuring range of 2.0 to 60 μm into 256 portions, and a particle size showing 50% of a volume addition molar fraction counted from the larger particles is determined as a volume-based median diameter (volume diameter $D_{50}$%).

[Developer]

Although the foil adhesion toner (α) and the image forming toner (β) according to the present invention can be used as a magnetic or non-magnetic mono-component developer, they can be used as a two-component developer mixed with a carrier. When the foil adhesion toner (α) and the image forming toner (β) of the present invention are used as a two-component developer, as a carrier magnetic particle, it can be used magnetic particles made of conventionally known materials including metals such as iron, ferrite, magnetite, alloys of these metals and aluminium or lead. Especially ferrite particles are preferable.

As a carrier, it may be uses a coat carrier in which the surface of the magnetic particle is covered with a coating material such as a resin, or a binder type carrier prepared by dispersing the magnetic substance powders in a binder resin.

As a coating resin which constitutes a coat carrier, although it is not limited in particular, it can be cited: an olefin resin, a styrene resin, a styrene-acrylic resin, a silicone resin, an ester resin, a fluoro resin, for example.

Moreover, especially as a resin which constitutes a resin dispersed type carrier, it is not limited, and known resins can be used, for example, a styrene-acrylic resin, a polyester resin, a fluoro resin, a phenol resin.

The volume-based average particle size of the carrier is preferably 20 to 100 μm, and more preferably 20 to 60 μm.

The volume-based average particle size of the carrier can be measured by a laser diffraction particle size analyzer HELOS (product by SYMPATEC Co.).

[Foil]

In the present invention, a "foil" is used, in order to produce a character or a picture having a metallic feeling or glossiness which is difficult to produce with a conventional printing method on an image supporting substrate. Although there are various types, such as a gold and silver foil for acquiring a gold and silver picture image, a color pigment foil for acquiring a color image having metallic luster, and a hologram foil for obtaining a hologram image, the types of foil used in the present invention are not limited in particular.

A foil is supplied to the foil image forming process as a transfer foil. A transfer foil 80 has, specifically, a layer structure as shown in FIG. 1 composed of a film-shaped support 80*a* having thereon a foil 80*c* via a releasing layer 80*b*. Specifically, the foil 80*c* is composed of a foil layer 80*d* containing a colorant or a metal which is formed on the releasing layer 80*b*, and an adhesive layer 80*e* which is formed on the foil layer 80*d* and exhibits adhesiveness.

The support 80*a* is made of a resin film, a resin sheet or paper. When the support 80*a* is made of a resin, examples of a resin used include conventionally known resin materials such as: a polyethylene terephthalate (PET) resin, a polyethylene naphthalate (PEN) resin, a polypropylene (PP) resin, a polyether sulfone resin and polyimide resin. In addition, the support 80*a* may be composed of a mono-layer or multiple layers.

The releasing layer 80*b* is provided for the purpose of acquiring a good releasing property from the support 80*a* of the foil 80*c* composed of the foil layer 80*d* and the adhesive layer 80*e*. Examples of a material for the release layer 80*b* include: a thermo-curable resin employing melamine or isocyanate as a hardener; and a UV curable resin or an electron beam curable resin containing an acrylic resin or an epoxy resin, which is added with a known wax such as a fluoro or silicon monomer or polymer.

The foil layer 80*d* contains, for example, a colorant or a metallic material, and, after it is transferred onto an image supporting substrate, the foil layer 80*d* provides an aesthetic appearance. Specifically, the foil layer 80*d* is composed of laminated layers made of a colorant layer and a metal layer.

The colorant layer of the foil layer 80*d* is expected to be smoothly released form the releasing layer 80*b* and to exhibit durability after forming a foil image. The colorant layer of the foil layer 80*d* can be formed by applying a well-known resin which meets the above properties on the releasing layer 80*b* provided on the support 80*a* using a coater, for example, a gravure coater, a micro-gravure coater or a roll coater. Examples of such a well-known resin to form the foil layer 80*d* include: an acrylic resin, a styrene resin and a melamine resin.

The metal layer of the foil layer 80*d* has a metallic luster and it is prepared using metals with well-known methods such as a vacuum evaporation method, a sputtering method and an ion plating method. Examples of a metal material for forming the metal layer include: a single materials such as aluminum, tin, silver, chromium, nickel and gold. Alloys, for example, a nickel chromium iron alloy, bronze and aluminum bronze are also usable in addition to the above metal carries. The metal layer may be set to be 10 to 100 nm. It is also possible to conduct a patterning process to provide a regular pattern using a well-known processing method, such as aqueous sealant processing, etching processing, and laser beam machining, for example, as a metal layer.

The adhesive layer 80*e* may be made of a thermo sensitive adhesive agent so called a hot melt adhesive agent, which exhibits an adhesive property when heated. Examples of a thermo sensitive adhesive agent include well known thermoplastic resins usable for a hot melt adhesive agent such as an acrylic resin, a vinyl chloride-vinyl acetate copolymer, an epoxy resin and an ethylene-vinyl alcohol copolymer. The adhesive layer 80*e* can be formed by applying an aforementioned resin on the foil layer 80*d* using a coater, for example, a gravure coater, a micro-gravure coater or a roll coater.

[Image Supporting Substrate]

As an image supporting substrate used for the present invention, it is not specifically limited as long as it can hold a foil image and a visible image thereon. Specific examples thereof include: a plain paper from thin paper to a thick paper, a high-quality paper, a printing paper such as an art paper or a coated paper, a various type of printing papers such as a Japanese paper marketed and a postcard paper, however, it is not limited to these.

[Image Forming Apparatus]

In the image forming method of the present invention, a foil image forming process and an overprinting process may be performed with a different image forming apparatus or they may be performed sequentially using the same image forming apparatus.

Figure 2:
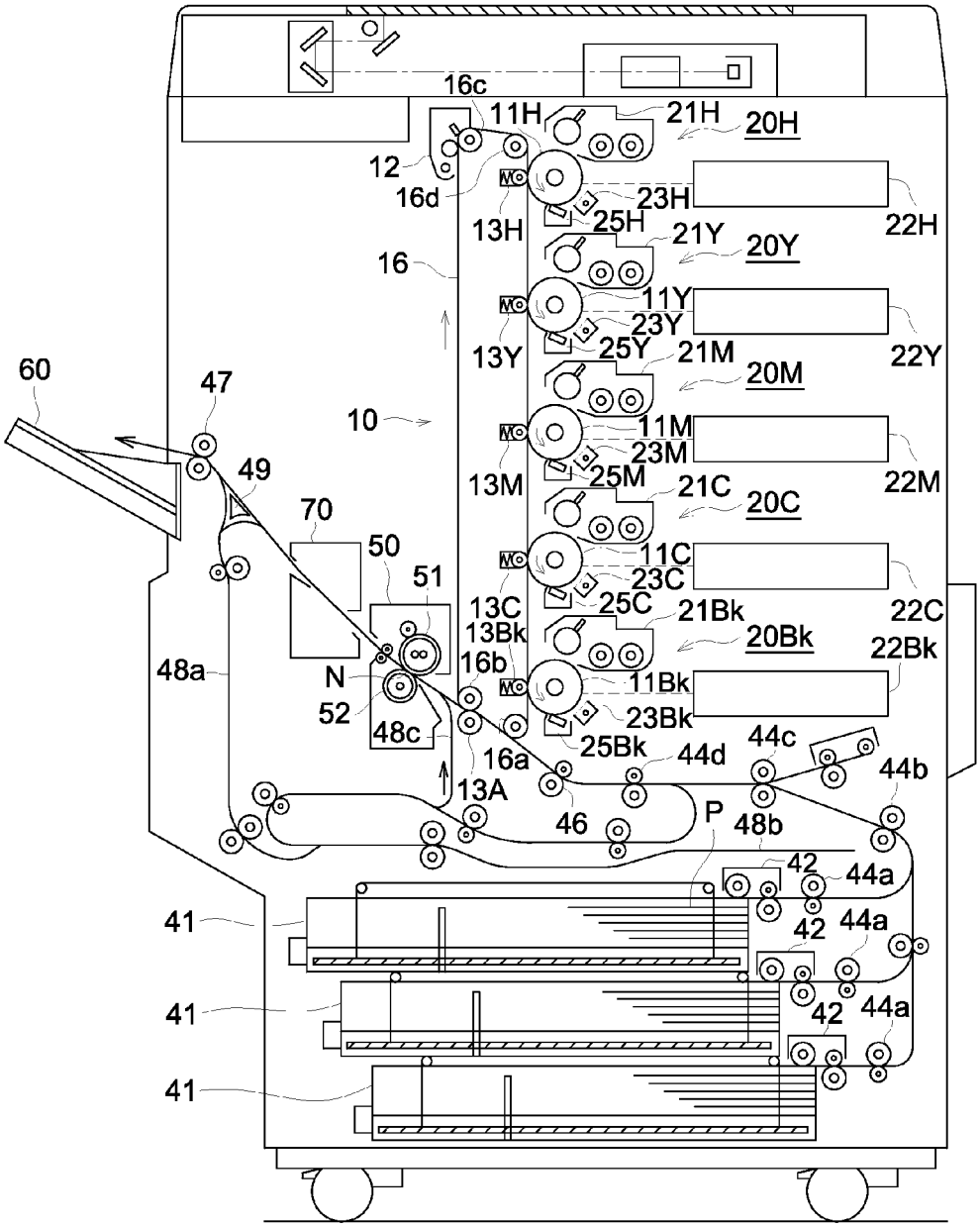
FIG. 2 is a cross-sectional view for explanation showing an example of the composition of the image forming apparatus for performing the image formation method of the present invention.

FIG. 2 is a cross-sectional view for explanation showing an example of the composition of the image forming apparatus for performing the image formation method of the present invention. This image forming apparatus is a "tandem-type color image forming apparatus" which can perform a foil image forming process using a foil adhesion toner (α) and an overprinting process using an image forming toner (β).

This image forming apparatus is composed of the following units: a foil adhesion toner image forming unit 20H which forms a foil adhesion toner image to form a foil image; color toner image forming units 20Y, 20M, 20C and 20Bk, each respectively forming a toner image of yellow, magenta, cyan and black; an intermediate transfer unit 10 which transfers the foil toner image formed by the foil adhesion toner image forming unit 20H or the color image toner formed by the color toner image forming units 20Y, 20M, 20C and 20Bk; a fixing device 50 which fixes the toner image by applying pressure to the image supporting substrate P while heating; and a foil transfer device 70 to supply a foil 80*c* (refer to FIGS. 4*a* to 4*e*) onto the image supporting substrate P.

An yellow toner image is formed in the color toner image forming units 20Y, a magenta toner image is formed in the color toner image forming units 20M, a cyan toner image is formed in the color toner image forming units 20C, and a black toner image is formed in the color toner image forming units 20Bk.

A foil adhesion toner image forming unit 20H is provided with: a photoreceptor 11H which is an electro static latent image carrier; a charging supplying member 23H which supplies uniform electric potential to the surface of the photoreceptor 11H; a light exposure member 22H which forms an electro static latent image having a required shape on the uniformly charged photoreceptors 11H; a developing member 21H which develops the electrostatic latent image by transporting the foil adhesion toner (α) on the photoreceptors 11H; and a cleaning member 25H which recovers the remained toner on the photoreceptor 11H after the primary transfer of the toner.

The color toner image forming units 20Y, 20M, 20C and 20Bk each respectively have the following constitution:

(1) photoreceptors 11Y, 11M, 11C and 11Bk, each being an electro static latent image carrier;

(2) charging supplying members 23Y, 23M, 23C and 23Bk, each supplying uniform electric potential to the surface of the photoreceptors 11Y, 11M, 11C and 11Bk;

(3) light exposure members 22Y, 22M, 22C and 22Bk, each forming an electro static latent image having a required shape on the uniformly charged photoreceptors 11Y, 11M, 11C and 11Bk;

(4) developing members 21Y, 21M, 21C and 21Bk, each developing the electrostatic latent image by transporting a color toner on the photoreceptors 11Y, 11M, 11C and 11Bk; and (5) cleaning members 25Y, 25M, 25C and 25Bk, each recovering the remained toner on the photoreceptors 11Y, 11M, 11C and 11Bk after the primary transfer of the toner.

The intermediate transfer unit 10 is composed of: an intermediate transfer member 16; a primary transfer roller 13H for transferring the foil adhesion toner image formed in a color toner image forming unit 20H onto the intermediated transfer member 16; primary transfer rollers 13Y, 13M, 13C and 13Bk for transferring the color toner images formed by the color toner image forming units 20Y, 20M, 20C and 20Bk; a secondary transferring roller 13A for transferring a foil adhesion toner image which has been transferred on the intermediated transfer member 16 by the primary transfer roller 13H, or visible toner images which have been transferred on the intermediated transfer member 16 by the primary transfer rollers 13Y, 13M, 13C and 13Bk onto an image supporting substrate P which has formed with the foil image thereon; and a cleaning member 12 for recovering the remained toner on the intermediated transfer member 16. The intermediated transfer member 16 is an endless belt extended and rotatably supported by a plurality of supporting rollers 16*a* to 16*d*.

A fixing device 50 is composed of a pair of heat-pressure rollers 51 and 52 which are pressed with each other to form a nip N.

Figure 3:
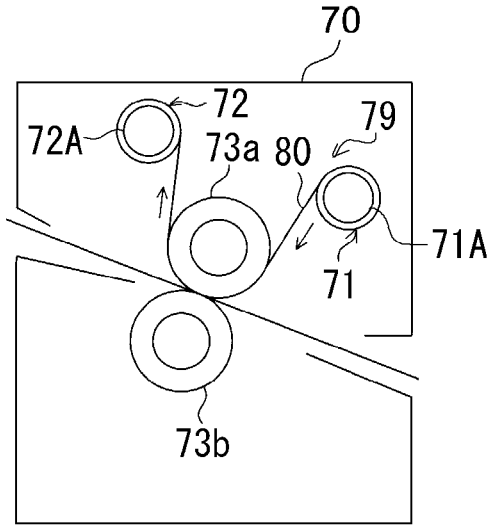
FIG. 3 is a cross-sectional view for explanation showing an example of the composition of foil transfer device.

As shown in FIG. 3, a foil transfer device 70 is composed of: a foil transfer roller 73*a* which is clockwise rotated by driving with an suitable driving member; a foil transfer roller 73*b* which is rotated by following the movement of the foil transfer roller 73*a*, the foil transfer rollers 73*a* and 73*b* being mutually pressed through a transfer foil 80 having a long sheet shape having a foil 80*c* which should be supplied to the image supporting substrate P; and a transporting member 79 which makes the transfer foil 80 to move.

In this foil transfer device 70, there is provided with a keep-apart mechanism (not shown in the figure) to change the foil transfer rollers 73*a* and 73*b* in a condition of separating with each other. The keep-apart mechanism changes the location of the foil transfer rollers 73*a* and 73*b* into the state of mutually separated when the image supporting substrate P having formed with a foil image S and a visible image and discharged from the fixing device 50 is passed through the foil transfer device 70.

A transportation member 79 for transporting the transfer foil 80 is winded with the transfer foil 80. In order to prevent from loosening the transfer foil 80, there are provided with a transfer foil supply member 71 having a transfer foil roller 71A which has applied a reverse tension, and a transfer foil winding member 72 having a transfer foil winding roller 72A which is rotated in an anti-clockwise direction (an arrow direction in the figure) with a driving source. The transport direction of the transfer foil 80 is made in the same direction as the moving direction of the surface of the foil transfer roller 73*a*. The rotating speed of the transfer foil winding roller 72A of the transportation member 79 is set so that the transportation speed of the transfer foil 80 at the pressing portion of the foil transfer rollers 73*a* and 73*b* becomes the same as the transportation speed of the image supporting substrate P.

A heating source (not shown in the figure) is provided with the foil transfer rollers 73*a* and 73*b*.

[Foil Image Formation Process]

In the above-described image forming apparatus, at first, in a foil adhesion toner image forming unit 20H, a photoreceptor 11H is electrically charged with a charging supplying member 23H, then an electrostatic latent image is formed by exposing with a light exposure members 22H, and a foil adhesion toner image is formed by developing with a foil adhesion toner (α) in a developing member 21H. The developed foil adhesion toner image is transferred onto an intermediate transfer member 16 by a primary transfer roller 13H. On the other hand, an image supporting substrate P stored in a paper supplying cassette 41 is supplied with a paper supplying transport member 42 and transferred with a plurality of paper supplying rollers 44*a*, 44*b*, 44*c*, 44*d* and a regist roller 46, and the foil adhesion toner image formed on the intermediate transfer member 16 is transferred on the image supporting substrate P in a secondary transferring roller 13A. Subsequently, the foil adhesion toner image transferred on the image supporting substrate P is fixed with pressure and heat in a fixing device 50 to form a foil adhesion toner image potion H.

Although the fixing condition of the fixing device 50 in the foil image formation process depend on the kind of the foil adhesion toner (α) and the kind of the image forming toner (β) it can be set as follows, for example.

(i) Heating temperature: 170 to 230° C.

(ii) Nip time: 50 to 500 msec

Here, the nip time can be calculated by the following expression:

{(Transportation direction length of the nip portion of heat-pressure rollers 51 and 52)/(Line speed(mm/sec)}×1,000.

Moreover, the heating temperature in the foil image formation process indicates the surface temperature of the heat-pressure roller 51 which contacts with the transferred foil adhesion toner image on the image supporting substrate P.

The image supporting substrate P having been formed with the foil adhesion toner image potion H is conveyed in the foil transfer device 70 and the transfer foil 80 which is winded around the transfer foil supply member 71 by the transportation member 79 is driven with the transfer foil winding roller 72A to be rotated. Thus, the image supporting substrate P is transported through the conveying path to pass the pressed portion of the foil transfer rollers 73*a* and 73*b*.

Figure 4A:
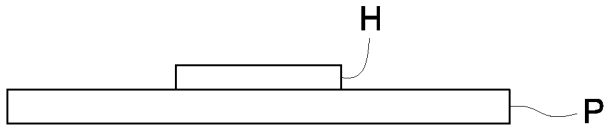
FIGS. 4*a* to 4*e* represents a schematic diagram for describing a foil image forming process.
Figure 4B:
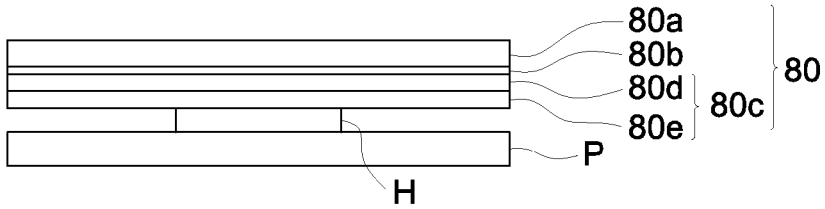
Figure 4C:
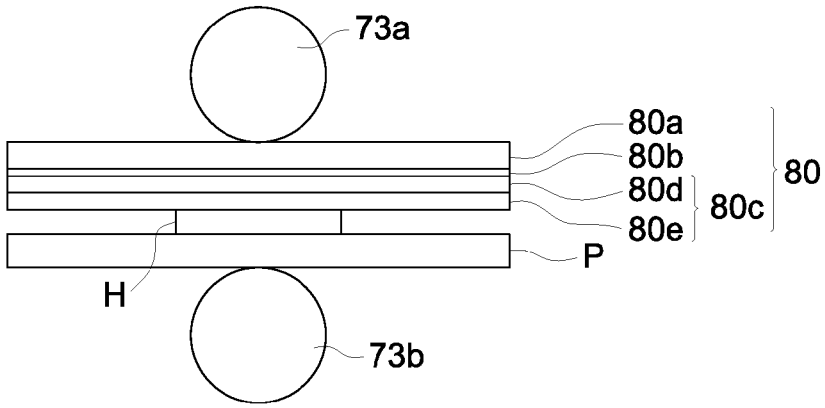
Figure 4D:
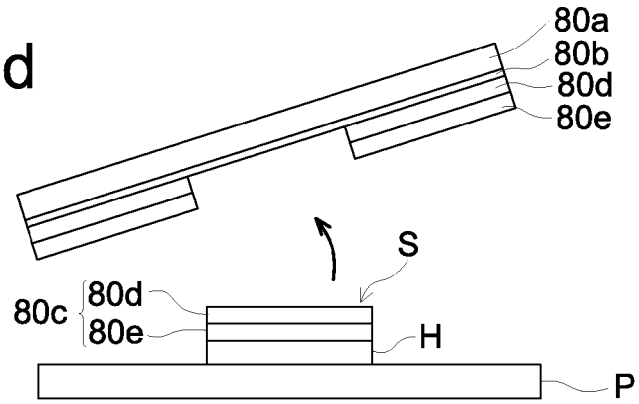
Figure 4E:
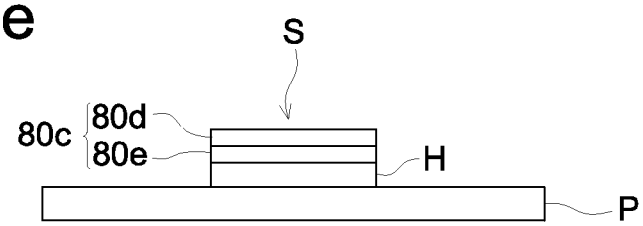

In the pressed portion of the foil transfer rollers 73*a* and 73*b*, as is shown in FIG. 4, the conveyed transfer foil 80 is contacted to be laminated (FIG. 4*b*) on the image supporting substrate P having been formed with the foil adhesion toner image potion H (FIG. 4*a*). In this state, heat is applied with the foil transfer rollers 73*a* and 73*b* (FIG. 4*c*), then after being passed the pressed portion of the foil transfer rollers 73*a* and 73*b*, and then being left cooled, the foil 80*c* is adhered to the foil adhesion toner image potion H. The portion of the foil 80*c* in the transfer foil 80 which is not contacted with the foil adhesion toner image potion H is peeled off (FIG. 4*d*) to form a foil image S which corresponds to the shape of the foil adhesion toner image potion H (FIG. 4*e*). The portion of the foil 80*c* in the transfer foil 80 which is not contacted with the foil adhesion toner image potion H is winded around the transfer foil winding roller 72A with a support 80*a* and a releasing layer 80*b*.

Although the fixing condition of the foil transfer device 70 depend on the kind of the foil adhesion toner (α) and the kind of the image forming toner (β), it can be set as follows, for example.

(i) Heating temperature: 170 to 230° C.

(ii) Nip time: 50 to 500 msec

Here, the nip time can be calculated by the following expression:

{(Transportation direction length of the nip portion of heat-pressure rollers 51 and 52)/(Line speed(mm/sec)}×1,000.

The heating temperature indicates the surface temperature of the heat-pressure roller 73*a* which contacts with the surface of the foil adhesion toner image portion H formed on the image supporting substrate P.

[Overprinting Process]

The image supporting substrate P on which is formed the foil image S is once conveyed through a discharge path having a paper eject roller 47, and then, it is conveyed in a reverse direction via a branch plate 49 through conveyance paths 48*a* and 48*b* to a secondary transfer roller 13A, and a visible toner image is transferred.

Specifically, in the color toner image forming units 20Y, 20M, 20C and 20Bk, the photoreceptors 11Y, 11M, 11C and 11Bk are charged with the charging supplying members 23Y, 23M, 23C and 23Bk. Then electrostatic latent images are formed by exposure with the light exposure members 22Y, 22M, 22C and 22Bk. The formed electrostatic latent images are developed with an image forming toner (β) in the developing members 21Y, 21M, 21C and 21Bk to form visible color images of each color. The formed visible color images of each color are superposed with the primary transfer rollers 13Y, 13M, 13C and 13Bk and they are transferred to the intermediate transfer member 16. Then the transferred visible color images of each color transferred on the intermediate transfer member 16 are collectively transferred on the image supporting substrate P having formed with the foil image S via the secondary transfer roller 13A.

The transferred visible color images on the image supporting substrate P having formed with the foil image S is fixed by applying a heat-pressure treatment to heat and press in the fixing device 50 to form a visible image. Subsequently, the image supporting substrate P formed with the foil image S and the visible image is passed through the foil transfer rollers 73*a* and 73*b* each being in a separated state in the foil transfer device 70. Further, this image supporting substrate P is ejected out of the apparatus by the eject roller 47 to be put on a paper eject tray 60.

In the overprinting process, the visible image may be formed on a region of the image supporting substrate P where the foil image S is not formed, or it may be formed on the foil image S.

The fixing condition of the fixing device 50 in the overprinting process is preferably as follows: (i) Heating temperature: 150 to 230° C., more preferably, 160 to 190° C.; and (ii) Nip time: 10 to 300 msec, more preferably, 20 to 70 msec.

Moreover, the heating temperature in the overprinting process indicates the surface temperature of the heat-pressure roller 51 which contacts with the visible toner image on the image supporting substrate P.

By controlling the heating temperature and the nip time in the overprinting process to be in the above-described range, it is securely prevented inducing of fluidity which will deform the foil adhesion toner image portion H adhering the foil 80*c* by the heat given in the overprinting process. When the heating temperature is too high or the nip time is too long in the overprinting process, the foil adhesion toner image portion H adhering the foil 80*c* will become soft and will be deformed, and there may arise stripes caused by distortion of the foil 80*c* which is adhered on the image supporting substrate P by application of pressure.

The photoreceptor 11H after transferring the foil adhesion toner image on the intermediate transfer member 16 is cleaned to remove the residual toner remained on the photoreceptor 11H by a cleaning member 25H, then the photoreceptor 11H is used for the next foil adhesion toner image formation.

The photoreceptors 11Y, 11M, 11C and 11Bk after transferring the visible images of each color on the intermediate transfer member 16 is cleaned to remove the residual toner remained on the photoreceptors 11Y, 11M, 11C and 11Bk by the cleaning member 25Y, 25M, 25C and 25Bk, then these photoreceptors are used for the next visible toner image formation.

On the other hand, the intermediate transfer member 16 after transferring the foil adhesion toner image or the visible toner images of each color on the image supporting substrate P with the secondary transfer roller 13A is cleaned to remove the residual toner remained on the intermediate transfer member 16 by the cleaning member 12, then it is used for the next intermediate transfer of the foil adhesion toner image or the visible toner images of each color.

It is preferable that the heating temperature and the nip time in the overprinting process are respectively the same as the heating temperature and the nip time in the formation step of the foil adhesion toner image from the viewpoints of controlling the fixing device and improvement of production efficiency.

According to the image forming method as described above, the softening points of the foil adhesion toner (α) and the image forming toner (β) are controlled to be in the specific range. As a result, even when the heat-pressure treatment is applied to fix the visible toner image, it is extremely prevented inducing of fluidity caused by melting or softening of the foil adhesion toner image portion H formed with the foil adhesion toner (α) by the applied heat. Therefore, there will not be produced the stripes caused by distortion of the foil 80*c* which is adhered on the image supporting substrate P by application of pressure. Therefore, it can form a visible image under the condition that the expected finish state in the foil image forming process is maintained. Consequently, an image having both a foil image of an excellent finish state and an expected visible image can be easily produced.

As mentioned above, although the embodiments of the present invention are described concretely, the embodiments of the present invention are not limited to the above-mentioned examples, and various changes can be made.

For example, although it was described above the case in which a foil image S and a visible image were formed on the one side of the image supporting substrate P, it is possible to form a foil image and a visible image respectively on each of the two sides of the image supporting substrate. In this case, although a foil image (S2) and a visible image (T2) may be formed in the rear side of the image supporting substrate after forming a foil image (S1) and a visible image (T1) on the front side of the image supporting substrate, it is desirable to form a foil image (S1) on the front side of the image supporting substrate first, then to form a foil image (S2) on the rear side of the image supporting substrate, then further, to form a visible image (T1) the front side of the image supporting substrate, and next further, to form a visible image (T2) on the rear side of the image supporting substrate finally.

Moreover, for example, it is not limited to the composition in which the intermediate transfer unit 10 is commonly used in the foil image forming process and in the overprinting process, but the intermediate transfer unit 10 may be provided to each of the two processes. In such composition, it is not limited to use the same fixing devise for forming the foil adhesion toner image portion and for forming the visible image, but two fixing devices may be separately provided to each image formation.

EXAMPLES

The embodiments of the present invention will now be specifically described with the reference to examples, however, the present invention is not limited thereto. Incidentally, a weight average molecular weight (Mw) of the resin particles and the softening point of the foil adhesion toner are measured as described above.

[Preparation of Foil Adhesion Toner A: Toner Made by Emulsion Polymerization Association Method]

(1) Preparation of Resin Particles A (First Step Polymerization)

In a reaction vessel fitted with a stirrer, a temperature sensor, a cooling pipe, and a nitrogen introducing unit, 4 mass parts of sodium polyoxyethylene(2)dodecyl ether sulfate was added to 3,000 mass parts of ion-exchanged water. The temperature of the liquid was increased to 80° C., while stirring at rotating speed of 230 rpm under a nitrogen stream.

After increasing the liquid temperature, a polymerization initiator solution prepared by dissolving 4 mass parts of potassium persulfate (KPS) in 200 mass parts of ion-exchanged water was added to the aforesaid solution. After increasing the liquid temperature to 75° C., a polymerizable monomer solution composed of the compounds described below was dropped over one hour. After dropping the aforesaid polymerizable monomer solution, polymerization reaction underwent while stirred and heated at 75° C. for two hours, whereby "Resin particle dispersion liquid A1" dispersed with "Resin particles A1" was prepared. The weight average molecular weight of formed "Resin particles A1" determined by the gel permuation chromatography method described above was 300,000.

Herein, the monomer solution described above has the following composition:

| | |
|---|---|
| Styrene | 567 mass parts |
| n-Butyl acrylate | 165 mass parts |
| Methacrylic acid | 68 mass parts. |

(Second Step Polymerization)

In a reaction vessel fitted with a stirrer, a temperature sensor, a cooling pipe, and a nitrogen introducing unit, 2 mass parts of sodium polyoxyethylene(2)dodecyl ether sulfate was added to 1,270 mass parts of ion-exchanged water and the liquid temperature was increased to 80° C. Thereafter, 40 mass parts in terms of solids of the aforesaid "Resin particle dispersion liquid A1" and a polymerizable monomer solution composed of the compounds described below were added thereto, by employing a mechanical homogenizer "CLEARMIX" (produced by M Technique Co.) provided with a circulating path, a mixing and dispersing treatment was carried out over 1 hours and an emulsion particle dispersion liquid was prepared.

Herein, the monomer solution described above has the following composition, WEP-5 was also dissolved:

| | |
|---|---|
| Styrene | 123 mass parts |
| n-Butyl acrylate | 45 mass parts |
| Methacrylic acid | 20 mass parts |
| n-Octylmercaptan | 0.5 mass parts |
| WEP-5 (fatty acid ester, made by Nippon Yushi Co.) | 82 mass parts |

Subsequently, a polymerization initiator solution prepared by dissolving 5 mass parts of potassium persulfate (KPS) in 100 mass parts of ion-exchanged water was added to the aforesaid emulsion particle dispersion liquid. After addition, polymerization reaction was performed while stirring and heating at 80° C. for 1 hour, whereby "Resin particle dispersion liquid A2" dispersed with "Resin particles A2" was prepared.

(Third Step Polymerization)

A polymerization initiator solution prepared by dissolving 10 parts by mass of potassium persulfate (KPS) in 200 parts by mass of ion-exchanged water was added to "Resin particles dispersion liquid A2". After increasing the liquid temperature to 80° C., a polymerizable monomer solution composed of the compounds described below was dropped over one hour.

Herein, the monomer solution described above has the following composition:

| | |
|---|---|
| Styrene | 393 mass parts |
| n-Butyl acrylate | 125 mass parts |
| Methacrylic acid | 51 mass parts |
| n-Octylmercaptan | 13 mass parts |

After dropping the aforesaid polymerizable monomer solution, a polymerization reaction was performed by heating at 80° C. and stirring over two hours. Thereafter, the temperature was lowered to 28° C., whereby "Resin particle dispersion liquid A3" dispersed with "Resin particles A3" was prepared.

(2) Preparation of "Foil Adhesion Toner A"

Into a reaction vessel fitted with a stirrer, a temperature sensor, a cooling pipe, and a nitrogen introducing unit, the followings were placed.

| | |
|---|---|
| "Resin particle dispersion liquid A3" | 450 mass parts (in terms of solid) |
| Ion-exchanged water | 1,100 mass parts |
| Sodium dodecyl sulfate | 2 mass parts |

After regulating the inside temperature of the reaction vessel to be 30° C. while stirring, the pH was regulated to 10 by adding a 5 mol/L aqueous potassium hydroxide solution.

Subsequently, an aqueous solution, prepared by dissolving 60 mass parts of magnesium chloride hexahydrate in 60 mass parts of ion-exchanged water, was added at 30° C. while stirred over 10 minutes. After the addition, the resulting mixture was allowed to stand still for three minutes, followed by further heating. The temperature of the above system was increased to 85° C. over 60 minutes. While keeping at 85° C., the aggregation and fusion process of "Resin particles A3" was continued. Subsequently, the average diameter of aggregated particles was determined via "COULTER COUNTER MULTISIZER 3" (produced by Beckmann Coulter Co.), and when the volume-based median diameter reached 6.7 μm, an aqueous solution prepared by dissolving 200 mass parts of sodium chloride in 860 mass parts of ion-exchanged water was added, and particle growth by aggregation was terminated.

After terminating the aggregation, as a ripening treatment, the liquid temperature was regulated to 95° C., and fusion between "Resin particles A3" was allowed to continue via heating and stirring over 8 hours, whereby "Toner mother particles A" was prepared. After the ripening treatment, the liquid temperature was cooled to 30° C., and the pH of the liquid was regulated to 2 by adding hydrochloric acid and stop stirring.

The above prepared "Toner mother particles A" was solid-liquid separated by using basket type centrifuge "MARK III, type 60×40 (produced by Matsumoto Machine Mfg. Co., Ltd.)", whereby a wet cake of "Toner mother particle A" was prepared. The wet cake was washed with ion-exchanged water at 40° C. by using the basket type centrifuge above until an electric conductivity of filtrate reached 5 μS/cm. After the washing process, drying was carried out by "Flash Jet Dryer (produced by Seishin Enterprise Co., Ltd)" to the water content of 0.5 mass %, whereby "Toner mother particles A" was prepared.

External Addition Process:

The following external additives were added to 100 mass parts of the prepared "Toner mother particle A" by employing a Henschel mixer (produced by Mitsui Miike Mining Co., Ltd.), whereby "Foil adhesion toner A" was prepared.

| | |
|---|---|
| Hexamethylsilazane-treated silica (average primary particle diameter of 12 nm, hydrophobized degree of 68) | 1.0 mass part |

-continued

| | |
|---|---|
| n-Octylsilane-treated titanium dioxide (average primary particle diameter of 20 nm, hydrophobized degree of 63) | 0.3 mass parts. |

Here, the external addition process was carried out in such a manner that by employing a Henschel mixer, mixing was performed under the conditions of a stirring blade peripheral rate of 35 m/second, a processing temperature of 35° C., and a processing period of 15 minutes.

The prepared "Foil adhesion toner A" had a volume-based median diameter of 6.7 μm, the softening point by the method described above of 1270° C., and the high molecular polymer component ratio having a weight average molecular weight (Mw) of 60,000 or more being 20 mass %.

[Preparation of Foil Adhesion Toners B to E, G and H: Toners Made by Emulsion Polymerization Association Method]

Foil adhesion toners B to E, G and H were prepared in the same manner as used for the preparation of Foil adhesion toner A, except that: the amount of the resin particles prepared in the First step polymerization and the amount of n-octylmercaptan both of which are used in the Second step polymerization and the amount of the monomers used in the Third step polymerization were changed as are shown in Table 1. The volume-based median diameter, the softening point and the high molecular polymer component ratio of the prepared Foil adhesion toners B to E, G and H are shown in Table 1.

[Preparation of Image Forming Toner Cy: Toner Made by Emulsion Polymerization Association Method]

(1) Preparation of "Resin Particles Cy"

A "Resin particle dispersion liquid Cy" dispersed with the "Resin particles Cy" was prepared in the same manner as used for the preparation of "Toner particles A3" in Preparation of Foil adhesion toner A, except that: the amount of n-octylmercaptan which was used in the Second step polymerization and the amount of the monomers used in the Third step polymerization were changed as are shown in Table 1.

(2) Preparation of "Colorant Particle Dispersion Liquid Cy"

27 mass parts of sodium n-dodecyl sulfonate was dissolved in 500 mass parts of ion-exchanged water with stirring. With keeping the stirring, 10 mass parts of colorant C. I. Pigment Blue 15:3 was gradually added. Then, the mixture was subjected to a dispersion treatment by employing a mechanical homogenizer "CLEARMIX" (produced by M Technique Co.) to obtain "Colorant particle dispersion liquid c-1" containing dispersed colorant particles. The particle size of the obtained "Colorant particle dispersion liquid c-1" was measured using an electrophoretic light scattering photometer "ELS-800" (made by Otsuka Electmnics, Co., Ltd.). The volume-based median diameter thereof was determined to be 98 nm.

(3) Preparation of "Image Forming Toner Cy"

In a 5 L four necked reaction vessel fitted with a stirrer, a temperature sensor, a cooling pipe, and a nitrogen introducing unit were placed 1,250 g of "Resin particle dispersion liquid Cy", 2,000 g of ion-exchanged water and 165 g of "Colorant particle dispersion liquid c-1", and the mixture was stirred to prepare an association solution. After adjusting the inner temperature of this association solution to be 30° C., a 5 mol/L aqueous potassium hydroxide solution was added to adjust the pH value to be 10.0. Subsequently, an aqueous solution, prepared by dissolving 52.6 g of magnesium chloride hexahydrate in 72 g of ion-exchanged water, was added at 30° C. while stirred over 10 minutes. After the addition, the resulting mixture was allowed to stand still for three minutes, followed by further heating. The temperature of the above system was increased to 90° C. over 6 minutes (temperature increasing rate: 10° C./min). In this state, the average diameter of associated particles was determined via "COULTER COUNTER MULTISIZER 3" (produced by Beckmann Coulter Co.), and when the volume-based median diameter reached 6.7 μm, an aqueous solution prepared by dissolving 200 mass parts 115 g of sodium chloride in 700 g of ion-exchanged water was added, and particle growth by aggregation was terminated. Further, the mixture was heated at 90±2° C. and stirred for 6 hours to continue fusion of particles. The average circularity of the associated particles was measured with "FPIA-2100" (made by Sysmex, Co. Ltd.), and it was determined as 0.958.

Then, the liquid temperature was cooled to 30° C. under the condition of temperature decreasing rate of 6° C./min. The associated particles were filtered and washed repeatedly with ion-exchanged water of 45° C., followed by drying with a an air of 40° C. to obtain "Toner mother particles Cy".

External Addition Process:

The following external additives were added to 100 mass parts of the prepared "Toner mother particles Cy" by employing a Henschel mixer (produced by Mitsui Miike Mining Co., Ltd.), whereby "Image forming toner Cy" for producing a visible cyan image was prepared.

| | |
|---|---|
| Hexamethylsilazane-treated silica (average primary particle diameter of 12 nm, hydrophobized degree of 68) | 1.0 mass part |
| n-Octylsilane-treated titanium dioxide (average primary particle diameter of 20 nm, hydrophobized degree of 63) | 0.3 mass parts. |

Here, the external addition process was carried out in such a manner that by employing a Henschel mixer, mixing was performed under the conditions of a stirring blade peripheral rate of 35 m/second, a processing temperature of 35° C., and a processing period of 15 minutes. The softening point of the prepared "Image forming toner Cy" is shown in Table 1.

[Preparation of Image Forming Toner Bk: Toner Made by Emulsion Polymerization Association Method]

(1) Preparation of "Resin Particles Bk"

"Resin particle dispersion liquid Bk" dispersed with the "Resin particles Bk" was prepared in the same manner as used for the preparation of "Toner particles A3" in Preparation of Foil adhesion toner A, except that: the amount of n-octylrn-ercaptan which was used in the Second step polymerization and the amount of the monomers used in the Third step polymerization were changed as are shown in Table 1.

(2) Preparation of "Colorant Particle Dispersion Liquid Bk"

"Colorant particle dispersion liquid k-1" was prepared in the same manner as used for the preparation of "Colorant particle dispersion liquid Cy" in the preparation of Image forming toner Cy, except that 10 mass parts of colorant C. I. Pigment Blue 15:3 was replaced with 30 mass parts of carbon black. The obtained "Colorant particle dispersion liquid k-1" contains colorant particles having a volume-based median diameter of 98 nm.

(3) Preparation of "Image Forming Toner Bk"

"Image forming toner Bk" of a black color was prepared in the same manner as used for the preparation of "Image forming toner Cy", except that "Colorant particle dispersion liquid c-1" was replaced with "Colorant particle dispersion liquid k-1". The softening point of the prepared "Image forming toner Bk" is shown in Table 1.

TABLE 1

| | First Step | Second Step | Third Step Polymerization | | | | | |
|---|---|---|---|---|---|---|---|---|
| Toner No. | Polymerization Resin particles (mass parts) | Polymerization n-Octylmercaptan (mass parts) | Styrene (mass parts) | n-Butyl acrylate (mass parts) | Methacrylic acid (mass parts) | Tsp(α) (° C.) | Tsp(β) (° C.) | High molecular polymer component ratio (mass %) |
| A | 40 | 0.5 | 393.3 | 125.4 | 51.3 | 127 | — | 20 |
| B | 40 | 2 | 427.5 | 131.1 | 11.4 | 112 | — | 15 |
| C | 200 | 0.2 | 330.6 | 125.4 | 114 | 157 | — | 28 |
| D | 60 | 2 | 427.5 | 131.1 | 11.4 | 113 | — | 16 |
| E | 100 | 0.5 | 376.2 | 125.4 | 68.4 | 135 | — | 24 |
| F | — | — | — | — | — | 113 | — | 8 |
| G | 2 | 2 | 427.5 | 131.1 | 11.4 | 111 | — | 3 |
| H | 300 | 0.2 | 330.6 | 125.4 | 114 | 159 | — | 35 |
| Cy | 40 | 2 | 430.9 | 131.1 | 8 | — | 107 | — |
| Bk | 40 | 2 | 432.6 | 131.1 | 16.5 | — | 117 | — |

[Preparation of Foil Adhesion Toner F: Toner Made by Pulverization Method]

(1) Mixing Process

The following materials were mixed with a Henschel mixer (made by Mitsui Miike Mining Co., Ltd.) for 5 minutes under the condition of a stirring blade peripheral rate of 25 m/second.

| | |
|---|---|
| Polyester resin (bisphenol A-ethylene oxide adduct, condensed product of terephthalic acid and trimerit acid, weight average molecular weight: 20,000) | 95 mass parts |
| Polyester resin (bisphenol A-ethylene oxide adduct, condensed product of terephthalic acid and trimerit acid, weight average molecular weight: 80,000) | 5 mass parts |
| Wax (pentaerythritol tetrastearate) | 6 mass parts |
| Charge controlling agent (boron dibenzilic acid) | 1 mass part |

(2) Kneading Process

The obtained mixture was kneaded with a biaxial press kneader while heating at 110° C. to obtain a kneaded material, then this kneaded material was cooled.

(3) Pulverizing Process

The obtained kneaded material was coarsely pulverized with a hammer mill (made by Hosokawa Micron, Co., Ltd.), then it was finely pulverized with "Turbo Mill T-400" (made by Turbo Industrial, Co., Ltd.) to obtain fine particles.

(4) Classifying Process

The obtained fine particles were classified with a wind power classifier to carry out fine particle classification and to obtain "Toner mother particles F".

(5) External Addition Process

In the same manner as used for "Toner mother particle A", the following external additives were added to 100 mass parts of the prepared "Toner mother particle F" by employing a Henschel mixer (produced by Mitsui Miike Mining Co., Ltd.), whereby "Foil adhesion toner F" was prepared.

| | |
|---|---|
| Hexamethylsilazane-treated silica (average primary particle diameter of 12 nm, hydrophobized degree of 68) | 1.0 mass part |
| n-Octylsilane-treated titanium dioxide (average primary particle diameter of 20 nm, hydrophobized degree of 63) | 0.3 mass parts. |

[Preparation of Developers A to H, Cy and Bk]

To the prepared "Foil adhesion toners A to H" and "Image forming toners Cy and Bk" was added a ferrite carrier covered with a silicone resin and having a volume-based median diameter of 60 μm. Then, they were mixed using a V-shape mixer so that the content of the aforesaid toner became 6 mass % to prepare "Foil adhesion developers A to H" and "Image forming developers Cy and Bk".

Inventive Examples 1 to 12 and Comparative Examples 1 to 4

In accordance with the conditions listed in Table 2, there were produced Prints having test foil images Sa, Sb, SC and a visible image Ta using "Foil adhesion developers A to H" each respectively containing "Foil adhesion toners A to H", and "Image forming developers Cy and Bk" each respectively containing "Image forming toners Cy and Bk". The produce Prints were subjected to evaluations. The line width in the foil images Sa and Sb was 0.5 mm; and the magnitude of the character of the visible image Ta was 10.5 points.

The printing for evaluation was carried out using a modified digital image forming apparatus "bizhub PRO C6500" (made by Konica Minolta Business Technologies, Inc.) incorporating the Foil adhesion toner image forming device as shown in FIG. 2. As for an image supporting substrate P, it was used a commercially available B4 sized image support supporting substrate "OK Top Coat+" (basis weight of 157 g/m$^2$, thickness of 131 μm, made by Oji Paper). The toner supply amount for forming each toner image portion was set to 4 g/m$^2$. As a foil transfer sheet, a gold transfer foil "BL No. 2 Gold 2.8" made by Murata Kinpaku Co., Ltd was used.

The fixing device 50 was provided with: an upper heat-pressure roller made of an aluminium substrate of 100 mm diameter and 10 mm thickness covered with a 3 mm thick coating layer made of a silicone rubber layer and polytetrafluoroethylene (PTFE); and a lower heat-pressure roller made of an aluminium substrate of 100 mm diameter and 10 mm thickness covered with a 3 mm thick coating layer made of a silicone rubber layer. Inside each of the heat-pressure rollers was provided with a halogen lamp as a heating source and the temperature was controlled with a thermistor.

(1) Conditions of Fixing Device 50 in Foil Image Forming Process

Surface temperature of upper heat-pressure roller: 190° C.

Surface temperature of lower heat-pressure roller: 100° C.

Nip width (transportation direction length of the nip portion): 7 mm

Transportation speed of image supporting substrate (line speed): 100 mm/sec

Nip time: 70 msec

Transportation direction image supporting substrate: longitudinal direction

Ambience: normal temperature and normal humidity (20° C. and 50% RH)

(2) Conditions of Foil transfer device 70 in Foil image forming process

Surface temperature of foil transfer roller (upper): 150° C.

Surface temperature of oil transfer roller (lower): 100° C.

Nip width (transportation direction length of the nip portion): 7 mm

Transportation speed of image supporting substrate (line speed): 100 mm/sec

Nip time: 70 msec

Transportation direction image supporting substrate: longitudinal direction

Ambience: normal temperature and normal humidity (20° C. and 50% RH)

The fixing condition for the overprinting process was set to be the same as the fixing condition for the foil image forming process, except that the surface temperature of the upper and lower heat-pressure rollers and the nip time (transportation speed of image supporting substrate) were set as shown in Table 2.

As is shown in Table 2, Inventive example 12 was produced by controlling the surface temperature of the upper heat-pressure roller and the nip time to the same as the conditions as the fixing device in the foil image forming process. As a result, the waiting time to stabilize the heating temperature of the fixing device was eliminated and it was possible to prepare a sample in a shorter time compared with other samples.

The prepared Prints 1 to 16 were subjected to the evaluations to know the following: (i) adhesiveness of transfer foil; (ii) transferring property of visible image on foil image; and (iii) appearance of stripes after overprinting process.

(i) Adhesiveness of Transfer Foil

Figure 5:
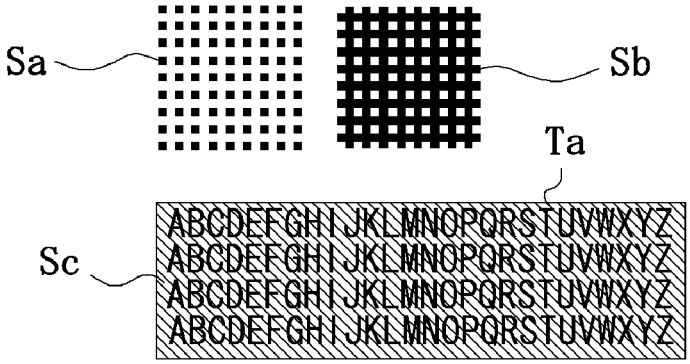
FIG. 5 is a schematic diagram of a printed matter having both a foil image and a visible image which are formed in examples of the present invention.

After pasting an adhesive tape "Scotch mending tape MP-18" (made of Sumitomo 3M, Co., Ltd.) on the two kinds of test images having the foil images Sa and Sb shown in FIG. 5, the adhesive tape was peeled off manually. The condition of the foil image after peeling off the adhesive tape was observed using the naked eye and a loupe having a 10 time magnification and was evaluated according to the following evaluation criteria. In this evaluation, rank 3 and rank 2 are considered to have no problem for practical use.

(Evaluation Criteria)

Rank 3: No minute peeling observable with the loupe having a magnification of 10 times is found, Rank 2: Minute peeling observable by the loupe having a magnification of 10 times is found, however, it is judged to be non-problematic by naked eye inspection, and Rank 1: Peeling which is observable is found by naked eye inspection.

(ii) Transferring Property of Visible Image on Foil Image

The visible image Ta composed of alphabet characters formed on the foil image Sc of the test print shown in FIG. 5 was observed using the naked eye and a loupe having a 10 time magnification and was evaluated according to the following evaluation criteria. In this evaluation, rank 3 and rank 2 are considered to have no problem for practical use.

(Evaluation Criteria)

Rank 3: Precise transfer of text image is observed by both naked eye inspection and employing a loupe, Rank 2: Non problematic finish is observed by naked eye inspection, however, a slight partial defect is observed by employing a loupe, and Rank 1: Partial defect is observed in toner image by naked eye inspection.

(iii) Appearance of Stripes

The foil image Sc of the test print shown in FIG. 5 was observed using the naked eye and a loupe having a 10 time magnification and was evaluated according to the following evaluation criteria. In this evaluation, rank 5 and rank 4 are considered to have no problem for practical use.

(Evaluation Criteria)

Rank 5: Stripe is not observed in by both naked eye inspection and employing a loupe, Rank 4: Stripe is not observed by naked eye inspection, however, one or two stripes are observed by inspection employing a loupe, Rank 3: Stripe is not observed by naked eye inspection, however, stripes are observed in 3 to 5 portions by inspection employing a loupe, Rank 2: Stripe is not observed by naked eye inspection, however, stripes are observed in 6 or more portions by inspection employing a loupe, Rank 1: Stripe is observed in 1 or more portions by naked eye inspection.

-continued

| | |
|---|---|
| 72A: | Transfer foil winding roller |
| 73a and 73b: | Foil transfer roller |
| 79: | Transportation member |
| 80: | Transfer foil |
| 80a: | Support |
| 80b: | Releasing layer |
| 80c: | Foil |
| 80d: | Foil layer |
| 80e: | Adhesive layer |
| N: | Nip portion |
| P: | Image supporting substrate |
| H: | Foil adhesion toner image portion |
| S, Sa and Sb: | Foil image |
| Ta, Tb and Tc: | Visible image |

TABLE 2

| | | | Toner | | | | | | Overprinting fixing conditions | | Evaluation results | | |
|---|---|---|---|---|---|---|---|---|---|---|---|---|---|
| | | Print No. | Toner (α) | Toner (β) | Difference of Softening points | Tsp (α) | Tsp (β) | High molecular polymer component ratio (mass %) | Surface temperature of upper roller (° C.) | Nip time (msec) | Adhesiveness of transfer foil | Transferring property of visible image | Appearance of stripes |
| Inventive Example | 1 | 1 | A | Cy | 20 | 127 | 107 | 20 | 180 | 40 | 3 | 3 | 5 |
| | 2 | 2 | B | Cy | 5 | 112 | 107 | 15 | 180 | 40 | 3 | 3 | 4 |
| | 3 | 3 | C | Cy | 50 | 157 | 107 | 28 | 180 | 40 | 2 | 3 | 5 |
| | 4 | 4 | D | Cy | 6 | 113 | 107 | 16 | 180 | 40 | 3 | 3 | 5 |
| | 5 | 5 | E | Cy | 28 | 135 | 107 | 24 | 180 | 40 | 3 | 3 | 5 |
| | 6 | 6 | A | Cy | 20 | 127 | 107 | 20 | 180 | 9 | 3 | 2 | 5 |
| | 7 | 7 | A | Cy | 20 | 127 | 107 | 20 | 180 | 310 | 3 | 3 | 4 |
| | 8 | 8 | A | Cy | 20 | 127 | 107 | 20 | 145 | 40 | 3 | 2 | 5 |
| | 9 | 9 | A | Cy | 20 | 127 | 107 | 20 | 235 | 40 | 3 | 3 | 4 |
| | 10 | 10 | F | Cy | 6 | 113 | 107 | 8 | 180 | 40 | 3 | 3 | 4 |
| | 11 | 11 | A | Bk | 20 | 137 | 117 | 20 | 180 | 40 | 3 | 3 | 5 |
| | 12 | 12 | A | Cy | 20 | 127 | 107 | 20 | 190 | 70 | 3 | 3 | 4 |
| Comparative Example | 1 | 13 | G | Cy | 4 | 111 | 107 | 3 | 180 | 40 | 3 | 3 | 1 |
| | 2 | 14 | H | Cy | 52 | 159 | 107 | 35 | 180 | 40 | 1 | 3 | 3 |
| | 3 | 15 | G | Cy | 4 | 111 | 107 | 3 | 160 | 40 | 2 | 1 | 5 |
| | 4 | 16 | G | Cy | 4 | 111 | 107 | 3 | 180 | 20 | 2 | 1 | 1 |

| | |
|---|---|
| 10: | Intermediate transfer unit |
| 11H, 11Y, 11M, 11C and 11Bk: | Photoreceptor |
| 12: | Cleaning member |
| 13H, 13Y, 13M, 13C and 13Bk: | Primary transfer roller |
| 13A: | Secondary transfer roller |
| 16: | Intermediate transfer member |
| 16a to 16d: | Supporting roller |
| 20H: | Foil adhesion toner image forming unit |
| 20Y, 20M, 20C and 20Bk: | Color toner image forming units |
| 21H, 21Y, 21M, 21C and 21Bk: | Developing member |
| 22H, 22Y, 22M, 22C and 22Bk: | Light exposure member |
| 23H, 23Y, 23M, 23C and 23Bk: | Charging supplying member |
| 25H, 25Y, 25M, 25C and 25Bk: | Cleaning member |
| 41: | Paper supplying cassette |
| 42: | Paper supplying transport member |
| 44a, 44b, 44c and 44d: | Paper supplying rollers |
| 46: | Regist roller |
| 47: | Paper eject roller |
| 48a, 48b and 48c: | Conveying path |
| 49: | Branch plate |
| 50: | Fixing device |
| 51 and 52: | Heat-pressure roller |
| 60: | Paper eject tray |
| 70: | Foil transfer device |
| 71: | Transfer foil supply member |
| 71A: | Transfer foil roller |
| 72: | Transfer foil winding member |

What is claimed is:

1. A method for forming an image comprising the sequential steps of:

forming a foil adhesion toner image on an image supporting substrate with a foil adhesion toner (.alpha.) which comprises at least a binder resin containing a thermoplastic resin using an electrophotographic method;

forming a foil image on the foil adhesion toner image by contacting a transfer foil on the foil adhesion toner image with applying heat to the transfer foil; and forming a visible toner image on the image supporting substrate which has been formed with the foil image with at least one image forming toner (β) using an, electrophotographic method, followed by fixing the visible toner image by applying heat and pressure thereto, wherein a difference of two softening points expressed as Δ(Tsp(α)−Tsp(β) is 5 to 50° C., provided that Tsp (α) is a softening point of the foil adhesion toner (α) and Tsp (β) is a softening point of the image forming toner (β).

2. The method for forming an image of claim 1, wherein the visible toner image is fixed at a temperature of 150 to 230° C. and a nip time for fixing the visible toner image is 10 to 300 msec.

3. The method for forming an image of claim 1, wherein the foil adhesion toner (α) has a softening point of 105 to 140° C., and the foil adhesion toner (α) contains a binder resin which has a resin component having a molecular weight (Mw) of 60,000 or more in a molecular weight distribution measured with GPC in an amount of 10 to 30 mass % based on the total amount of the binder resin.

4. The method for forming an image of claim 3, wherein the binder resin contained in the foil adhesion toner (α) is a styrene-acrylic resin.

5. The method for forming an image of claim 3, wherein the foil adhesion toner has a softening point of 112 to 137° C.

6. The method for forming an image of claim 3, wherein the binder resin contained in the foil adhesion toner (α) has a weight average molecular weight of 10,000 to 30.000.

7. The method for forming an image of claim 1, wherein the toll image and the visible toner image each are formed using the same fixing device with the same heating temperature and of the same nip time.

8. The method for forming an image of claim 1, wherein the difference of two softening points expressed as Δ(Tsp(α)−Tsp(β)) is 6 to 28° C.

9. The method for forming an image of claim 1, wherein the foil adhesion toner (α) is a clear toner.

* * * * *